United States Patent [19]

Booth

[11] Patent Number: 4,545,616

[45] Date of Patent: Oct. 8, 1985

[54] MOBILE CHAIR WITH ELEVATING SEAT

[75] Inventor: Eric Booth, Didcot, England

[73] Assignee: National Research Development Corporation, London, England

[21] Appl. No.: 582,471

[22] Filed: Feb. 22, 1984

[30] Foreign Application Priority Data

Feb. 25, 1983 [GB] United Kingdom ..... 8305331

[51] Int. Cl.[4] ..... A47C 1/02

[52] U.S. Cl. ..... 297/320; 297/348; 297/DIG. 10

[58] Field of Search ..... 297/320, 348, DIG. 10

[56] References Cited

U.S. PATENT DOCUMENTS 3,640,566 2/1972 Hodge ..... 297/DIG. 10
4,031,576 6/1977 Epstein ..... 297/DIG. 10

FOREIGN PATENT DOCUMENTS 977271 11/1975 Canada ..... 297/DIG. 10
2625046 12/1977 Fed. Rep. of Germany ... 207/DIG. 10
1424462 2/1976 United Kingdom .
1435559 5/1976 United Kingdom .
2014844 9/1979 United Kingdom .
1578742 11/1980 United Kingdom .

*Primary Examiner*—James T. McCall
*Attorney, Agent, or Firm*—Cushman, Darby & Cushman

[57] ABSTRACT

An invalid carriage including a chair of pivotted construction with a connection between the back of the chair and a mast that is fixed to a chassis. There are means to raise the connection up the mast, so raising the chair seat from horizontal to forwardly-sloping so as to help raise a user of the chair from a sitting to a standing position, and to lower the connection so that the reverse occurs so as to help a standing person to sit down in the chair. As the mast connection moves, so collapsing or expanding the chair framework, wheels allow the feet of the front legs of the chair to move backwards and forwards over the chassis. In an alternative construction the feet of the front legs are anchored to the chassis, and the foot of the mast rolls backwards and forwards over the chassis as the mast connection moves.

4 Claims, 7 Drawing Figures

MOBILE CHAIR WITH ELEVATING SEAT

This invention relates to mobile chairs mounted on wheels or other rolling supports, and especially to chairs of that kind which are peripatetic, that is to say which are not confined to rails or the like but which can be steered and can proceed on various headings over roads, paths, floors and other such surfaces. While the invention applies also to unpowered vehicles that an assistant must both push (or pull) and steer, it applies particularly to self-propelled invalid carriages.

While the users of invalid carriages often find the steering and propelling of them relatively simple, entering the chair from a standing position and especially the reverse process of rising out of the chair into a standing position often present difficulty. To help the user overcome such difficulties, designs of invalid carriage have been proposed in which the chair seat is capable of a powered motion which may assist the invalid when entering or rising. In one such design the seat is supported in cantilever fashion from a transverse pivot axis coinciding approximately with its front edge, that is to say with where the knees of the user will be when the chair is occupied, and a back rest carries the arm rests and is mounted on the rear edge of the seat. To assist an occupant from a sitting to a near-standing position, a motor rotates the seat about the front edge pivot from horizontal to near-vertical.

While such designs of chair have provided some real benefits to invalids, some practical disadvantages have also become apparent. For instance both the seat itself, and the pivot along its front edge, have had to be very robust and therefore heavy and/or costly in order to withstand the reaction they experience when the seat acts as a lever to raise or to help lower the mass of the invalid. This mass will in practice be concentrated closer to the rear of the seat then to the front and therefore at a substantial radius from the pivot axis. Also the joint between the seat and the back rest must be both robust and of variable geometry, to ensure that the backrest (which is supported only from the seat) remains vertical while the orientation of the seat is changing.

According to the present invention an invalid carriage comprises a chassis, a mast, a connection between the rear of the seat and the mast, means to raise and lower the connection up and down the mast whereby to move the seat and assist a user respectively to rise from the chair towards a standing position or to do the reverse, and means to incline the seat downwardly and forwardly when raised to facilitate a user's departure from or entry into the carriage.

The framework of the chair may be of pivotted construction, and the seat may change orientation from horizontal to sloping as it rises. The mast may be fixed to the chassis so that the front legs of the chair must be capable of horizontal movement to permit them to move backwards towards the mast as the rear of the seat rises. Alternatively, the front of the chair may be fixed relative to the chassis and the mast may be mounted so that it may move bodily forward over the chassis towards the fixed front of the chair as the rear of the seat rises. Arm, shoulder and other rests may be carried by the back of the chair, and the back may be connected to the mast so that this connection ensures both that the back remains vertical at all times and that it rises and falls to match the rising and falling of the rear of the seat.

The means to raise and lower the seat may be contained within the mast. For instance the mast may be in the form of a fluid-operated ram or other extending structure, or it may support a leadscrew on which followers connecting it to the seat run up and down. Alternatively, the means to raise and lower the seat may comprise rams or other devices of variable length, included within the pivotted framework of the chair.

As yet a further alternative the seat may be of saddle type, so that the user of the carriage may sit astride it. Such a design of seat offers the advantage that when it is fully raised with a user still astride, that user will be in what is virtually a normal, upright standing postion, with his legs vertical and his feet upon the ground and able to bear such proportion of his weight as they are able to, but with the saddle still horizontal and in place between his legs to offer him the balance of the support that he requires to stand. Means may also be provided to retract such a saddle seat to make it easier for the user to walk forwards away from and out of the carriage, or to walk backwards into it. For instance, there may be a pivotal connection between the back of the saddle and the mast, and the saddle may retract by pivotting downwards about this connection.

The invention is further defined by the claims at the end of this specification and will now be described, by way of example, with reference to the accompanying drawings in which:

Figure 1:
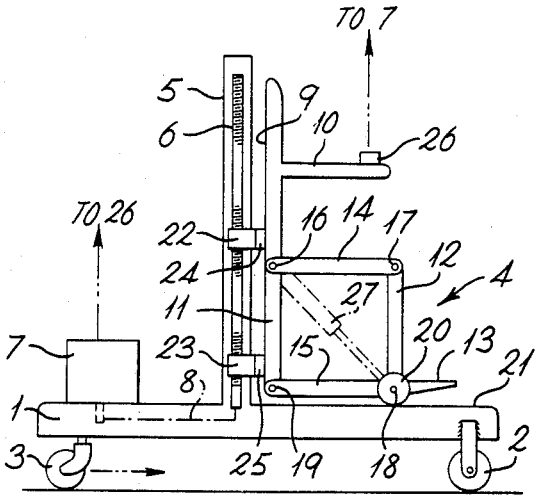
FIG. 1 is a diagrammatic side elevation of one carriage.

FIG. 1 shows an invalid carriage comprising a chassis 1 mounted on front wheels 2 and rear caster wheels 3 and carrying a chair 4 and a fixed mast 5. Some other standard features of such a carriage, for instance an attendant's handle, a motor to drive the front wheels and controls whereby the occupant may himself propel or steer the vehicle, are omitted for clarity and because they are not relevant to the present invention.

Figure 2:
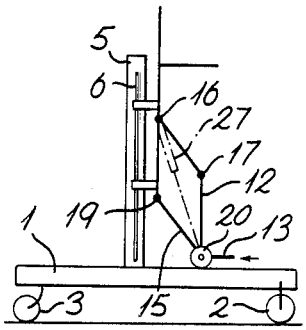
FIG. 2 is a schematic view of the same carriage, with seat partly raised.

The mast contains a leadscrew 6 which may be rotated by a battery/motor unit 7, to which it is connected by gears or the like indicated diagrammatically at 8. Chair 4 comprises a back 9 supporting arm rests 10 and formed integrally with rear legs 11, front legs 12 to which a footrest 13 is fixed, a seat 14 and struts 15 between the bases of the rear and front legs 11 and 12. Pivot joints 16–19 are provided so that the seat, the legs and the struts constitute a closed, parallelogram-type linkage, and wheels 20 mounted at the base of front legs 12 run on the top surface 21 of chassis 1. Threaded bushes 22, 23 run on leadscrew 6 and are respectively connected to back 9 and rear legs 11 by cross-members 24, 25. Rotation of leadscrew 6 by unit 7 causes bushes 22, 23 to move in unison up or down the leadscrew. When a user sitting in chair 4 wishes to rise to near-standing he places his feet on footrest 13 and operates a control, indicated in outline at 26, to energise unit 7 and rotate leadscrew 6 so that bushes 22, 23 rise up the leadscrew. This draws footrest 13 closer to mast 5 and causes the parallelogram linkage to change shape, as shown in FIG. 2, so that the rear of seat 14 rises and so helps the user to rise also. When the back 9 of the chair is raised to its highest position on the mast 5, wheels 20 will be close to the mast and seat 14 will be almost vertical. By standing on footrest 13 and supporting himself from armrests 10, the user will be in an almost upright position ready to step forward off and away from the carriage.

As an alternative to the leadscrew 6, the means for raising and lowering the chair could be mounted in the framework of the chair itself instead of within the mast, the latter acting simply as a static slideway for the bushes 22, 23. The means could, for example, take the form of a hydraulic ram, as shown in broken lines at 27, linking opposite pivotted joints 16 and 19 of the chair framework.

Figure 3:
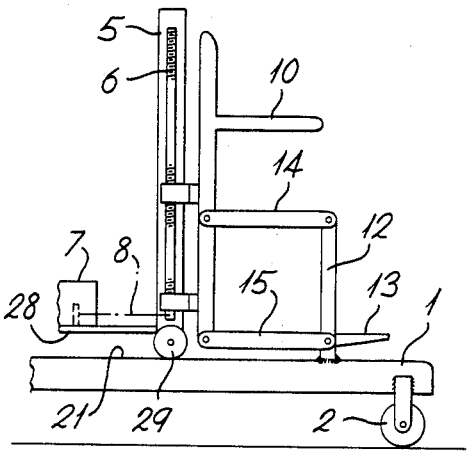
FIGS. 3 and 4 are similar to FIGS. 1 and 2 respectively, but show another carriage.
Figure 4:
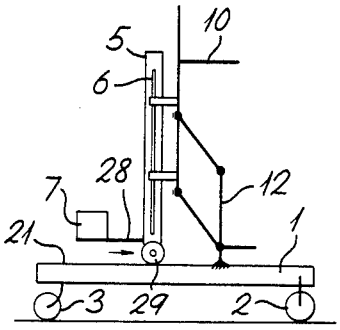

In the alternative carriage shown in FIGS. 3 and 4 pivot joints 16–19 are again present between the seat 14, the rear and front legs 11 and 12 and the struts 15, but now the front legs 12 and footrest 13 are anchored to chassis 1 just within the wheelbase of wheels 2, 3. Mast 5 carries a platform 28 on which unit 7 is mounted, and is itself mounted on wheels 29 to allow it to run backwards and forwards over the surface 21 of chassis 1. When unit 7 is now energised to rotate the leadscrew 6 so that bushes 22 and 23 rise, wheels 29 roll to allow mast 5 to move forwards over the chassis as the parallelogram linkage of the seat, legs and struts changes to the shape shown in FIG. 4. Again alternative means of causing the seat to rise and fall, like the ram unit 27 shown in FIGS. 1 and 2, could be substituted for the leadscrew 6.

Figure 5:
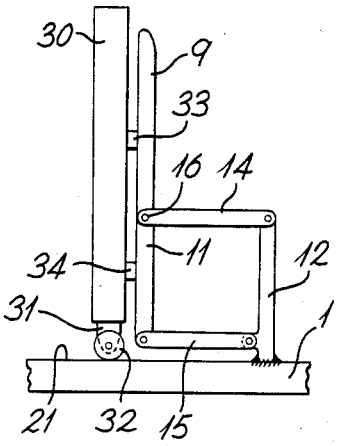
FIGS. 5 and 6 are diagrammatic side elevations of two further carriages.
Figure 6:
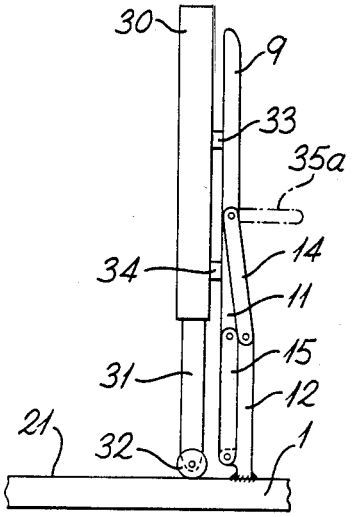

While generally similar to those shown in FIGS. 3 and 4, the carriage of FIG. 5 has a different arrangement of mast. Instead of a fixed column 5 supporting a leadscrew 6, the mast of this carriage is in the form of a hydraulic ram comprising a cylinder 30 and a piston 31, a wheel 32 being mounted on the free end of the latter. In place of the bushes 22 and 23, brackets 33 and 34 now connect the cylinder 28 to the back 9 and rear legs 11 of the chair respectively. FIG. 5 shows the chair in the lowered, sitting position and FIG. 6 shows the chair and cylinder 30 in the fully raised position in which piston 31 is fully exposed and in which wheel 32 has rolled forwards over the surface of chassis 1 to lie as close as possible to the fixed front legs 12 of the chair. With the framework of the chair now fully collapsed the struts 15 are folded to lie vertical, immediately behind front legs 12 and in alignment with rear legs 11 and chair back 9, and seat 14 is very nearly vertical.

Figure 7:
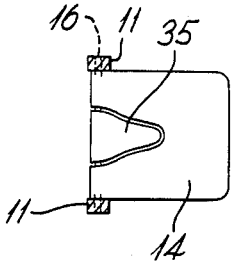
FIG. 7 is a plan view of an alternative form of seat.

As FIG. 7 shows, instead of being in one piece as normal the seat 14 could include a saddle-shaped insert 35 pivotted to the chair back 9 independently of the rest of the seat, but along the same joint 16. Motion of saddle 35 about axis 16 may be controlled, for instance by a catch or motor (not shown) so that as the chair rises, and the slope of the rest of seat 11 progressively increases, the saddle 35 remains at right angles to chair back 9 as shown in dotted lines 35*a* in FIG. 6. Contact between the user and the saddle may help both to raise the user from the sitting to the standing position, and then to support him steady in the latter position before he moves forward out of the carriage. To help him move forward the nose of the saddle may then be dropped, either by releasing the catch already mentioned so that the saddle pivots under gravity about the axis of joint 16, or in the alternative construction by operating the motor so that the saddle is pivotted under power. With certain types of user it is possible that a saddle alone would provide an adequate seat so that the carriage would essentially comprise only a saddle capable of moving up and down an elevating mast, and capable of pivotting downwards about the mast when in the raised position so as to facilitate walking departure of the user out of the carriage.

It will be observed that a common feature of all the carriages described with reference to the drawings is that the back 9 of the chair is firmly supported by the mast to which it is closely attached, and is vertical at all times. The firm feel of the back is reassuring to an occupant, and this combined with the vertical orientation makes it easier for the occupant to maintain his back vertical whenever he is in the chair and thus, for example, to avoid leaning forward as the seat rises to raise him into a standing position.

It should be appreciated that the Figures show only a rudimentary arrangement of wheels (2, 3) for the chassis to run on. In practice other wheel arrangements will give greater stability and comfort and be preferable in may other ways: for example, the arrangement described in UK Pat. No. 1,578,742.

I claim:

1. An invalid carriage comprising:

a chassis;

a chair of pivotted framework construction including a seat and front legs, said front legs receiving support from said chassis;

a mast fixed to said chassis;

a connection between the rear of said seat and said mast, and means to raise and lower said connection up and down said mast, whereby when so raising said connection to tilt said seat into a forwardly-sloping orientation and so assist a user to rise from said seat into a near-standing position, and when so lowering said connection again to return said seat from a forwardly-sloping orientation to horizontal and so facilitate the change in position of an intending user of said chair from standing to sitting;

and in which the means of said support of said front legs on said chassis are movable, whereby when said connection rises up said mast said movable support means move backwards over said chassis towards said mast.

2. An invalid carriage comprising:

a chassis;

a chair of pivotted framework construction including a seat, and front legs fixed to said chassis;

a mast movably supported upon said chassis;

a connection between the rear of said seat and said mast, and means to raise and lower said connection up and down said mast, whereby when so raising said connection to tilt said seat into a forwardly-sloping orientation and so assist a user to rise from said seat into a near-standing position, and when so lowering said connection again to return said seat from a forwardly-sloping orientation to horizontal and so facilitate the change in position of an intending user of said chair from standing to sitting, and whereby when said connection rises said mast moves bodily forwards over said chassis towards said front legs of said chair.

3. An invalid carriage comprising:

a chassis;

a chair of pivotted framework construction including a seat, and front legs resting upon the chassis;

a mast supported upon the chassis;

a connection between the rear of said seat and said mast, and means contained within said mast to raise and lower said connection up and down said mast, whereby when so raising said connection to tilt said seat into a forwardly-sloping orientation and so assist a user to rise from said seat into a near-standing position, and when so lowering said connection again to return said seat from a forwardly-sloping orientation to horizontal and so facilitate the change in position of an intending user of said chair from standing to sitting.

4. An invalid carriage according to claim 1 in which a footrest is fixed to said front legs so as to move with them over said chassis.

* * * * *